US011303065B2

(12) United States Patent
Wang et al.

(10) Patent No.: US 11,303,065 B2
(45) Date of Patent: Apr. 12, 2022

(54) LOW PROFILE FIRST CONNECTOR, SECOND CONNECTOR AND CONNECTOR ASSEMBLY

(71) Applicant: Dongguan Luxshare Technologies Co., Ltd, Dongguan (CN)

(72) Inventors: Kaide Wang, Dongguan (CN); Hongji Chen, Dongguan (CN)

(73) Assignee: DONGGUAN LUXSHARE TECHNOLOGIES CO., LTD, Dongguan (CN)

( * ) Notice: Subject to any disclaimer, the term of this patent is extended or adjusted under 35 U.S.C. 154(b) by 0 days.

(21) Appl. No.: 17/013,078

(22) Filed: Sep. 4, 2020

(65) Prior Publication Data

US 2021/0075159 A1 Mar. 11, 2021

(30) Foreign Application Priority Data

Sep. 7, 2019 (CN) ..... 201921488178.X
Sep. 7, 2019 (CN) ..... 201921488179.4

(51) Int. Cl.
*H01R 13/631* (2006.01)
*H01R 13/40* (2006.01)
(Continued)

(52) U.S. Cl.
CPC ..... *H01R 13/631* (2013.01); *H01R 12/7005* (2013.01); *H01R 12/71* (2013.01);
(Continued)

(58) Field of Classification Search
CPC .... H01R 13/631; H01R 13/40; H01R 13/502; H01R 13/6582; H01R 12/7005;
(Continued)

(56) References Cited

U.S. PATENT DOCUMENTS 8,439,706 B2 * 5/2013 Sytsma ..... H01R 13/658 439/607.46
8,454,381 B2 * 6/2013 Wu ..... H01R 13/506 439/352
(Continued)

FOREIGN PATENT DOCUMENTS

CN 208014938 U 10/2018
TW M579831 U * 6/2021 ..... H01R 13/40

*Primary Examiner* — Abdullah A Riyami
*Assistant Examiner* — Nader J Alhawamdeh
(74) *Attorney, Agent, or Firm* — Birch, Stewart, Kolasch & Birch, LLP

(57) ABSTRACT

The present disclosure relates to a connector assembly including a first connector and a second connector. The first connector including a first insulating body, a first terminal module and a first shell. The first insulating body includes a first top wall shielded by an upper wall of the first shell. The upper shell includes a locking plate. The first connector includes a receiving space between the first top wall and the locking plate for positioning the second connector. A width of the receiving space is narrower than a width of the slot. The second connector includes a second insulating body and a second terminal module. The second insulating body includes a main body, a tongue plate and an extending portion. The extending portion is located above the tongue plate. The extending portion and the tongue plate at least partially overlap along a vertical direction.

20 Claims, 18 Drawing Sheets

(51) Int. Cl.
*H01R 12/70* (2011.01)
*H01R 13/502* (2006.01)
*H01R 13/6582* (2011.01)
*H01R 12/71* (2011.01)

(52) U.S. Cl.
CPC ..... *H01R 13/40* (2013.01); *H01R 13/502* (2013.01); *H01R 13/6582* (2013.01)

(58) Field of Classification Search
CPC .. H01R 12/71; H01R 13/6271; H01R 13/629; H01R 12/72
See application file for complete search history.

(56) References Cited

U.S. PATENT DOCUMENTS 8,475,199 B2 * 7/2013 Wang ..... H01R 13/6275 439/353
8,905,777 B2 * 12/2014 Zhu ..... H01R 13/62 439/352
9,728,871 B1 * 8/2017 Gutgold ..... H01R 13/6275
10,084,271 B2 * 9/2018 Xing ..... H01R 12/59
10,096,944 B2 * 10/2018 Huang ..... H01R 13/6582
10,236,605 B1 * 3/2019 Henry ..... H01R 12/732
10,461,473 B1 * 10/2019 Hsiao ..... H01R 13/639
10,535,939 B1 * 1/2020 Qiao ..... H01R 13/504
10,868,387 B2 * 12/2020 Hsiao ..... H01R 12/62
10,879,634 B1 * 12/2020 Liao ..... H01R 12/77
11,075,476 B2 * 7/2021 Hsiao ..... H01R 13/504
2008/0038951 A1 * 2/2008 He ..... H01R 12/707 439/260
2009/0170357 A1 * 7/2009 Yamashita ..... H01R 12/707 439/157
2010/0273335 A1 * 10/2010 Wu ..... H01R 12/79 439/80
2019/0140385 A1 * 5/2019 Huo ..... H01R 13/42
2019/0267760 A1 * 8/2019 Chen ..... H01R 12/712
2020/0259294 A1 * 8/2020 Lu ..... H01R 12/57
2020/0321727 A1 * 10/2020 Li ..... H01R 13/6335
2020/0366019 A1 * 11/2020 Hsiao ..... H01R 13/6275
2020/0366025 A1 * 11/2020 Hsiao ..... H01R 43/205
2021/0075159 A1 * 3/2021 Wang ..... H01R 13/631
2021/0135402 A1 * 5/2021 Li ..... H01R 13/6335
2021/0175650 A1 * 6/2021 Hsiao ..... H01R 12/62
2021/0175663 A1 * 6/2021 Hsiao ..... H01R 13/629
2021/0265782 A1 * 8/2021 Wang ..... H01R 13/502

* cited by examiner

LOW PROFILE FIRST CONNECTOR, SECOND CONNECTOR AND CONNECTOR ASSEMBLY

CROSS-REFERENCE TO RELATED APPLICATION

The present disclosure requires priorities of a Chinese Patent Application filed on Sep. 7, 2019 with Application No. 201921488178.X and an invention titled "FIRST CONNECTOR, SECOND CONNECTOR AND CONNECTOR ASSEMBLY", and a Chinese Patent Application filed on Sep. 7, 2019 with Application No. 201921488179.4 and an invention titled "FIRST CONNECTOR, SECOND CONNECTOR AND CONNECTOR ASSEMBLY", the entire contents of which are incorporated into this application herein by reference.

TECHNICAL FIELD

The present disclosure relates to a first connector, a second connector and a connector assembly, which can be applied to a technical field of high-speed electrical connectors.

BACKGROUND

An existing connector assembly usually includes a first connector and a second connector which are mated with each other. The first connector includes a first insulating body, a plurality of first terminals and a first metal shell. The second connector includes a second insulating body and a plurality of second terminals. The first insulating body is provided with a slot into which the first terminals protrude. The second insulating body is provided with a main body and a tongue plate protruding from the main body and used for being inserted into the slot. The second terminals are distributed on upper and lower surfaces of the tongue plate. In addition, in order to realize the locking of the connectors after insertion, the main body of the second insulating body is usually provided with a locking structure, and correspondingly the first metal shell is provided with a locking hole that corresponds to the locking structure. However, the locking structure and the tongue plate in the prior art do not overlap in a vertical direction. This design will make a length of the connector longer, which is not beneficial to reduce the size thereof.

Besides, in order to realize inserting and positioning of the two connectors, the first insulating body of the first connector is usually designed to be relatively wide. As a result, it is convenient to provide positioning grooves on two sides of the first insulating housing to be able to clamp two sides of a metal shell of the second connector. However, this design is also not beneficial to reduce the size of the first connector.

SUMMARY

A purpose of the present disclosure is to provide a first connector, a second connector and a connector assembly which can be designed to be shorter in length.

In order to achieve the above purpose, the present disclosure discloses a first connector including a first insulating body, a first terminal module and a first shell shielding the first insulating body. The first insulating body includes a first top wall, a mating surface and a slot formed on the mating surface. The slot is adapted for receiving at least part of a second connector along a mating direction. The first terminal module includes a plurality of contact portions extending into the slot. The first shell includes an upper shell shielding the first top wall. The upper shell includes a locking plate for locking with the second connector. The first connector includes a receiving space provided between the first top wall and the locking plate for positioning the second connector. A width of the receiving space is narrower than a width of the slot along a width direction perpendicular to the mating direction.

The present disclosure also discloses a second connector including a second insulating body and a second terminal module. The second insulating body includes a main body, a tongue plate protruding from the main body and an extending portion protruding from the main body. The extending portion is located above the tongue plate. The extending portion and the tongue plate at least partially overlap along a vertical direction.

The present disclosure also discloses a connector assembly including a first connector and a second connector for mating with the first connector along a mating direction. The first connector includes a first insulating body, a first terminal module and a first shell shielding the first insulating body. The first insulating body includes a first top wall, a mating surface and a slot formed on the mating surface. The slot is adapted for receiving at least part of a second connector along a mating direction. The first terminal module includes a plurality of contact portions extending into the slot. The first shell includes an upper shell shielding the first top wall. The upper shell includes a locking plate for locking with the second connector. The first connector includes a receiving space provided between the first top wall and the locking plate for positioning the second connector. A width of the receiving space is narrower than a width of the slot along a width direction perpendicular to the mating direction. The second connector includes a second insulating body and a second terminal module. The second insulating body includes a main body, a tongue plate protruding from the main body and an extending portion protruding from the main body. The extending portion is located above the tongue plate. The extending portion and the tongue plate at least partially overlap along a vertical direction. When the first connector and the second connector are mated, the tongue plate is received in the slot, and the extending portion is received in the receiving space.

Compared with the prior art, the first connector of the present disclosure is provided with a receiving space between the first top wall and the locking plate for receiving the second connector. With this arrangement, a height of the first connector is well used while a length of the first connector along a front-rear direction is not additionally occupied, so that the length of the first connector can be designed to be shorter. Regarding the second connector of the present disclosure, a length thereof can be shortened by overlapping the extending portion with the tongue plate in the vertical direction. In addition, an overall length of the connector assembly according to the present disclosure can be shorten through the above designs.

DETAILED DESCRIPTION

Figure 1:
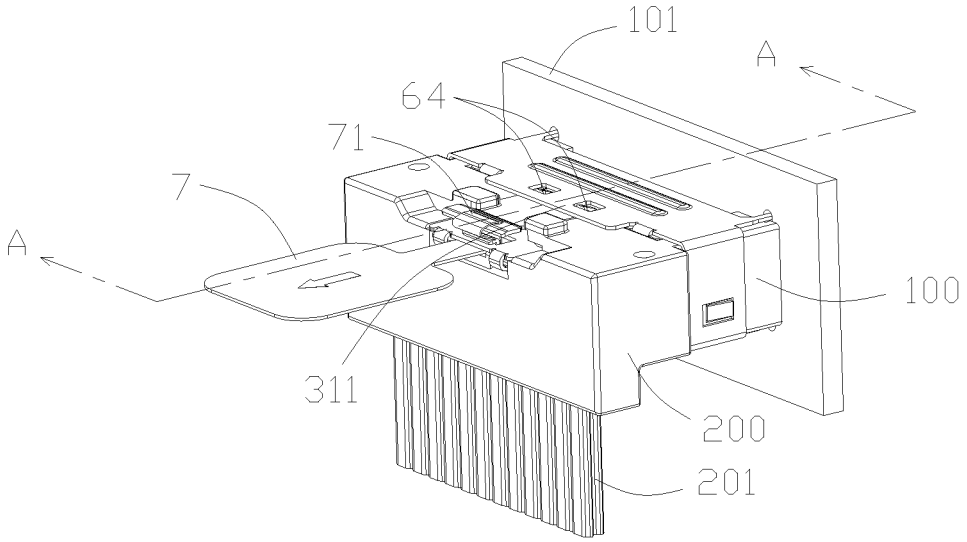
FIG. 1 is a schematic perspective view of a connector assembly of the present disclosure, in which a first connector is mounted on a printed circuit board.
Figure 2:
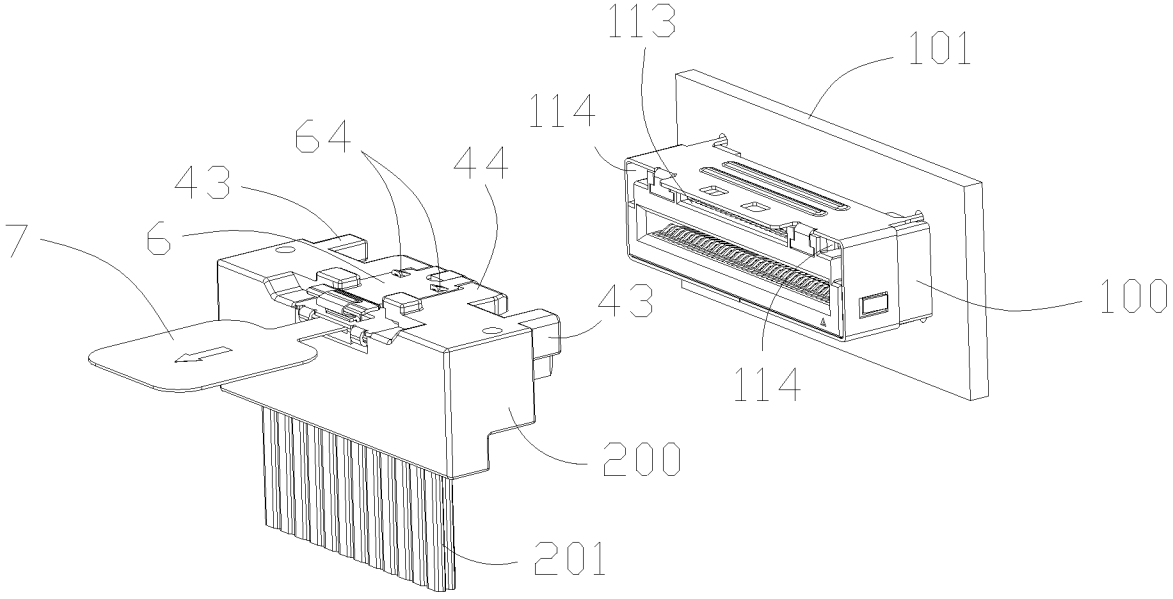
FIG. 2 is a partially exploded perspective view of FIG. 1.
Figure 3:
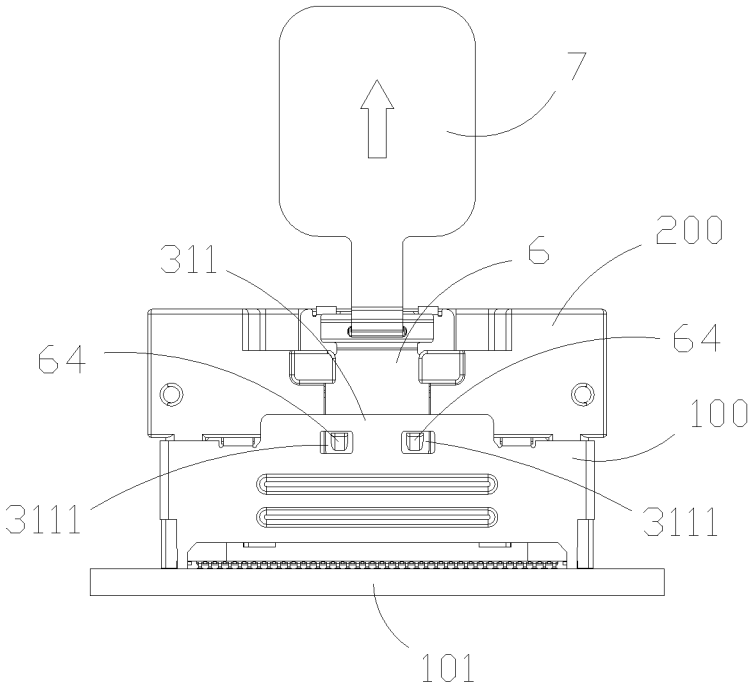
FIG. 3 is a plan view of FIG. 1.
Figure 4:
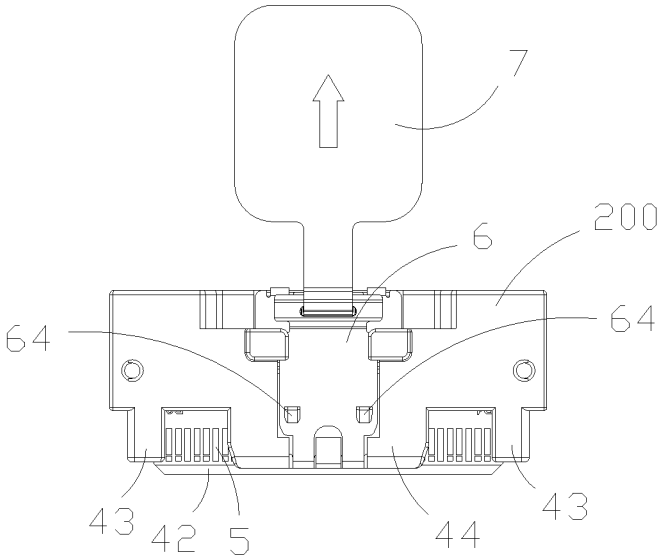
FIG. 4 is a schematic exploded view of FIG. 3.
Figure 4:
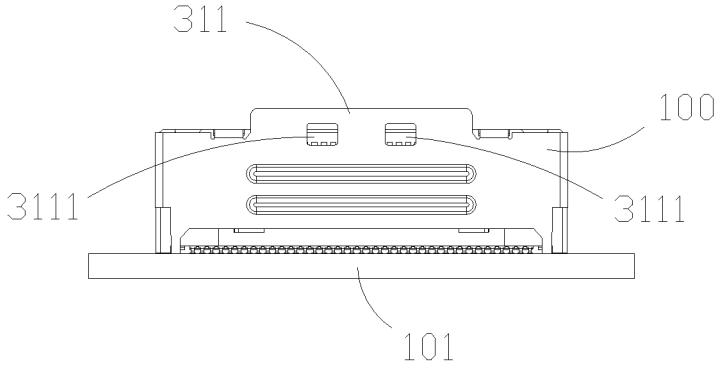
Figure 5:
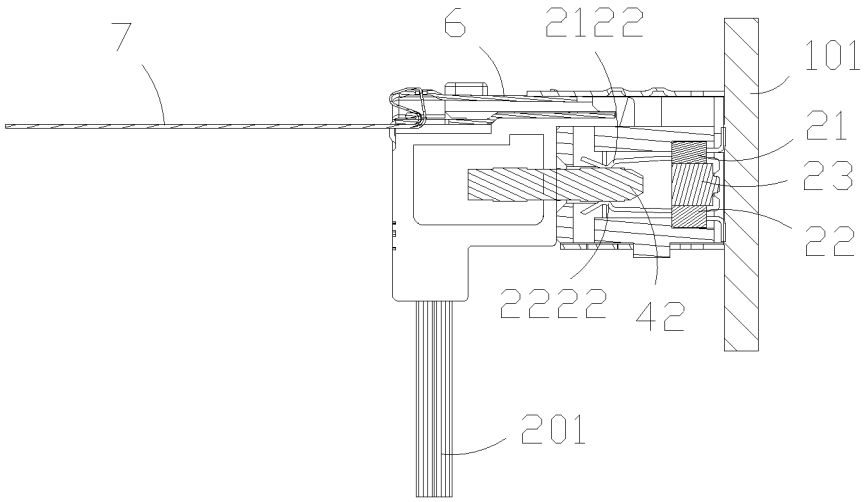
FIG. 5 is a schematic cross-sectional view taken along line A-A in FIG. 1.
Figure 6:
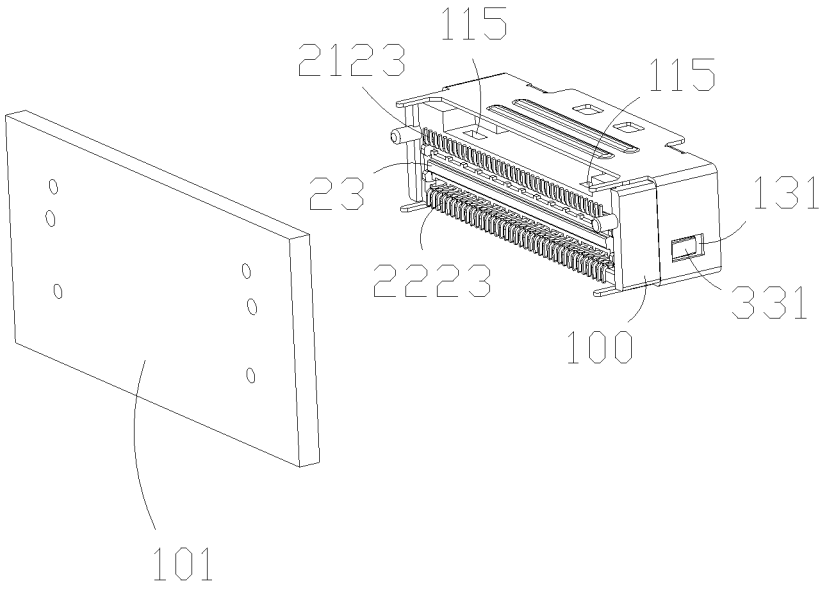
FIG. 6 is an exploded schematic view of the first connector and the printed circuit board in FIG. 2.
Figure 7:
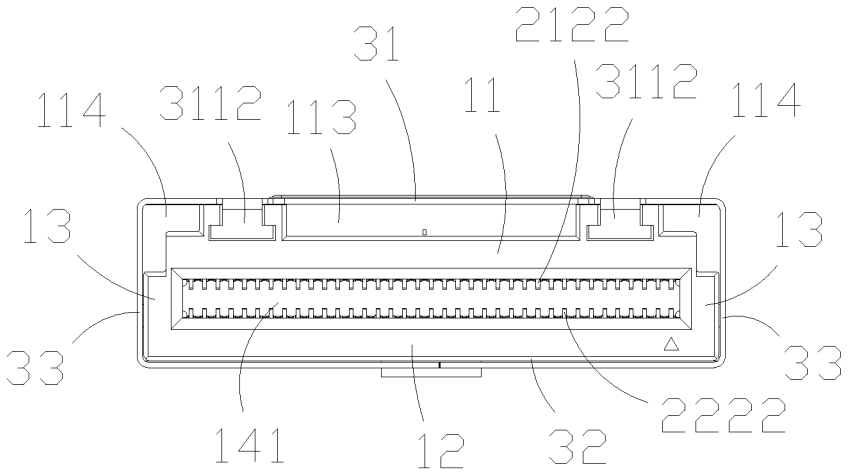
FIG. 7 is a front view of the first connector in FIG. 2.
Figure 8:
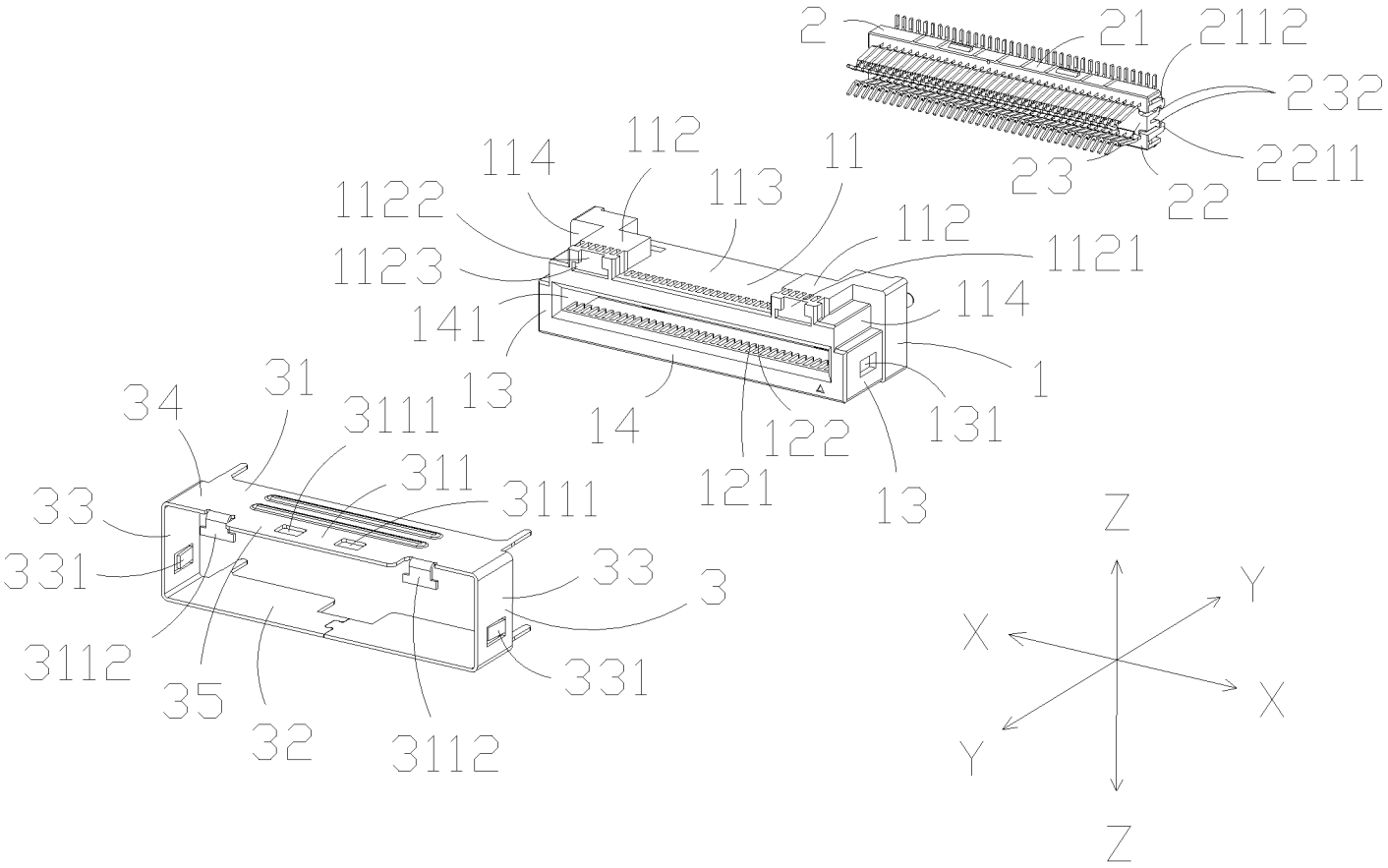
FIG. 8 is a partially exploded perspective view of the first connector.
Figure 9:
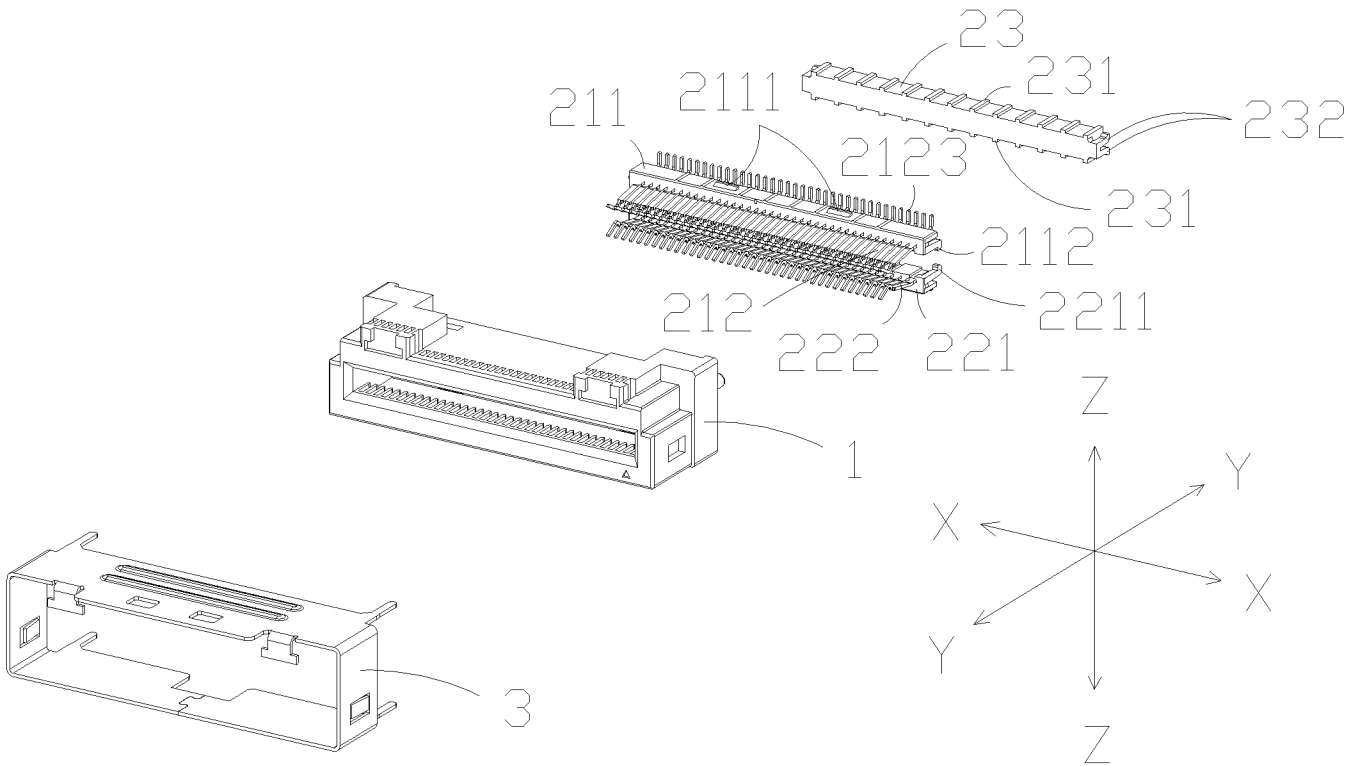
FIG. 9 is a further exploded perspective view of FIG. 8.
Figure 10:
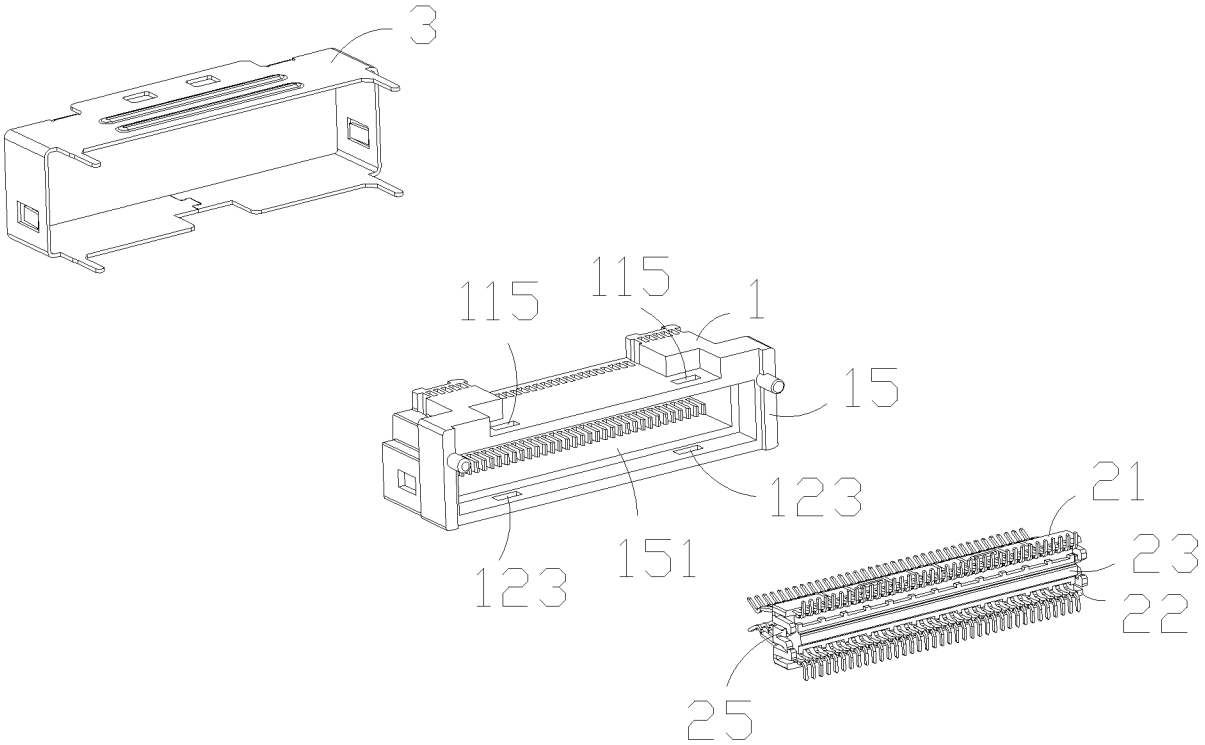
FIG. 10 is an exploded perspective view of FIG. 8 from another angle.
Figure 11:
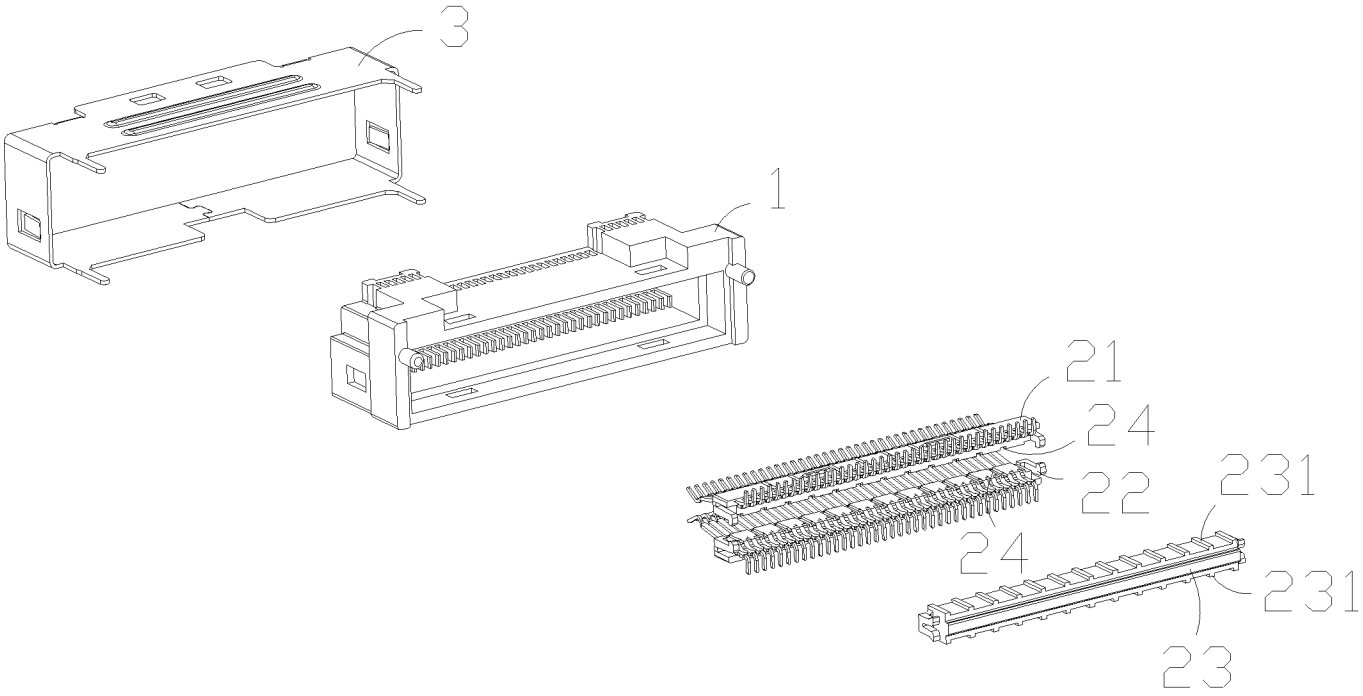
FIG. 11 is an exploded perspective view of FIG. 9 from another angle.
Figure 12:
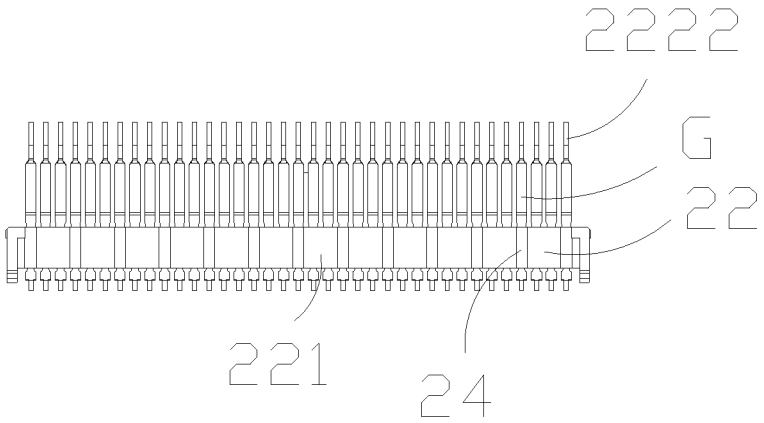
FIG. 12 is a top view of a first terminal unit in FIG. 11.
Figure 13:
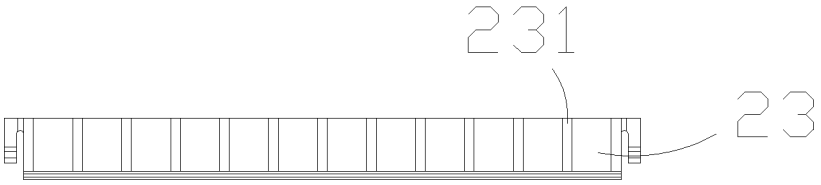
FIG. 13 is a top view of an insulator in FIG. 11.

Please refer to FIGS. 1 to 5, the present disclosure discloses a connector assembly which includes a first connector 100 and a second connector 200 mated with the first connector 100 along a mating direction. In an illustrated embodiment of the present disclosure, the first connector 100 is a board-end connector for being mounted to a printed circuit board 101, and the second connector 200 is a cable connector for being connected to cables 201.

Please refer to FIGS. 6 to 11, the first connector 100 includes a first insulating body 1, a first terminal module 2 mounted to the first insulating body 1, and a first shell 3 enclosing the periphery of the first insulating body 1. In the illustrated embodiment of the present disclosure, the first shell 3 is made of metal material.

The first insulating body 1 includes a mating surface 14 and a mounting surface 15 for mounting the first connector 100 to the printed circuit board 101. A slot 141 for receiving at least part of the second connector 200 is formed on the mating surface 14, and a mounting groove 151 for receiving the first terminal module 2 is formed on the mounting surface 15.

From a structural point of view, the first insulating body 1 generally includes a first top wall 11, a first bottom wall 12 and two first side walls 13 connecting the first top wall 11 and the first bottom wall 12. The slot 141 is enclosed by the first top wall 11, the first bottom wall 12 and the two first side walls 13. Both an inner side of the first top wall 11 and an inner side of the first bottom wall 12 are provided with a plurality of convex strips 121 arranged at intervals. A terminal groove 122 is formed between two adjacent convex strips 121. The first top wall 11 is further provided with two protrusions 112 adjacent to two sides thereof and a receiving space 113 between the two protrusions 112. Each protrusion 112 is provided with a notch 1121 on a front end surface thereof. In the illustrated embodiment of the present disclosure, the notch 1121 is of an inverted T shape, which includes a first notch 1122 at an upper end and a second notch 1123 at a lower end. The width of the first notch 1122 is smaller than the width of the second notch 1123 along a width direction perpendicular to the mating direction. In order to fix the first terminal module 2, the first top wall 11 and the first bottom wall 12 are further provided with a first slot 115 and a second slot 123, respectively. In addition, the two first side walls 13 are respectively provided with a retaining groove 131 located outside and used to mate with the first shell 3. The width of the receiving space 113 is smaller than the width of the slot 141 along the width direction perpendicular to the mating direction. In an embodiment of the present disclosure, the width of the receiving space 113 is less than two thirds of the width of the slot 141.

The first terminal module 2 includes a first terminal unit 21, a second terminal unit 22, and a conductive plastic 23 clamped between the first terminal unit 21 and the second terminal unit 22. Referring to FIGS. 8 to 11, in the illustrated embodiment of the present disclosure, the first terminal unit 21 and the second terminal unit 22 are symmetrically arranged on upper and lower sides of the conductive plastic 23. Preferably, the first terminal unit 21 and the second terminal unit 22 have the same configurations and only need to be turned 180 degrees during assembly.

The first terminal unit 21 is provided with a first insulator 211 and a plurality of first terminals 212 disposed in the first insulator 211. In an embodiment of the present disclosure, the first terminals 212 are insert-molded with the first insulator 211. The first insulator 211 is provided with a first locking block 2111 for mating with the first slot 115. From a structural point of view, each first terminal 212 includes a first fixing portion (not shown) disposed in the first insulator 211, a first contact portion 2122 extending forwardly from the first fixing portion, and a first welding portion 2123 bending and extending backwardly from the first fixing portion. From a functional point of view, the first terminals 212 include a plurality of signal terminals and a plurality of ground terminals. Two adjacent signal terminals are located between two ground terminals so as to form a group. The first terminals 212 include multiple groups of such signal terminals and ground terminals.

Similarly, the second terminal unit 22 is provided with a second insulator 221 and a plurality of second terminals 222 disposed in the second insulator 221. In an embodiment of the present disclosure, the second terminals 222 are insert-molded with the second insulator 221. The second insulator 221 is provided with a second locking block (not shown) for mating with the second slot 123. From a structural point of view, each second terminal 222 includes a second fixing portion (not shown) disposed in the second insulator 221, a second contact portion 2222 extending forwardly from the second fixing portion, and a second welding portion 2223 bending and extending backwardly from the second fixing portion. From a functional point of view, the second terminals 222 include a plurality of signal terminals and a plurality of ground terminals. Two adjacent signal terminals are located between two ground terminals so as to form a group. The second terminals 222 include multiple groups of such signal terminals and ground terminals.

Please refer to FIGS. 9 to 13, the conductive plastic 23 is provided with a plurality of protruding ribs 231 on its upper and lower surfaces, and the inner surfaces of the first insulator 211 and the second insulator 221 are respectively provided with a plurality of grooves 24 for mating with the protruding ribs 231. In addition, the conductive plastic 23, the first insulator 211 and the second insulator 221 are also provided with a plurality of clamping arms 25 which are locked with each other to prevent the conductive plastic 23 from withdrawing backwardly after being inserted. In the illustrated embodiment of the present disclosure, the conductive plastic 23 is provided with a first engaging arm 232, and the first insulator 211 and the second insulator 221 are further provided with a second engaging arm 2112 and a third engaging arm 2211, respectively. The second engaging arm 2112 and the third engaging arm 2211 are respectively engaged with the first engaging arm 232. It should be noted that in the illustrated embodiment of the present disclosure, the conductive plastic 23 is isolated from the first terminal 212 and the second terminal 222 by a plastic layer, and the protruding ribs 231 of the conductive plastic 23 are not in direct contact with the first terminals 212 and the second terminals 222. Please refer to FIG. 12, positions of the grooves 24 correspond to positions of the ground terminals (G) among the first terminals 212 and the second terminals 222.

When the first terminal module 2 is completely inserted in the mounting groove 151 along a back-to-front direction, the first locking block 2111 and the second locking block are respectively locked in the first slot 115 and the mounting groove 151 to prevent the first terminal module 2 from exiting backwardly. At this time, the first contact portions 2122 and the second contact portions 2222 are respectively located in the corresponding terminal grooves 122 so as to protect the terminals. In addition, the first contact portions 2122 and the second contact portions 2222 extend toward each other and both protrude into the slot 141 for mating with the second connector 200.

The first shell 3 is substantially frame-shaped and sleeved on the first insulating body 1. The first shell 3 includes an upper shell 31 shielding the first top wall 11, a lower shell 32 covering the first bottom wall 12, and two side shells 33 connecting the upper shell 31 and the lower shell 32 and respectively shielding the two first side walls 13. The upper shell 31 covers the protrusions 112 and are supported by the protrusions 112. In the embodiment of the present disclosure, the upper shell 31, the lower shell 32 and the side shells 33 may be integrally formed as one piece.

The first connector 100 is provided with two guiding slots 114 for guiding the second connector 200 when inserted. The guiding slots 114 are used to cooperate with the second connector 200 to realize positioning when they are mated with each other. Please refer to FIG. 7, in the illustrated embodiment of the present disclosure, the guiding slots 114 are formed by the first insulating body 1 and the first shell 3. Of course, in other embodiments, the guiding slots 114 may also be formed by the first insulating body 1 or by the first shell 3. In the illustrated embodiment of the present disclosure, each of the two the guiding slots 114 is L-shaped and is provided on the top surface and the side surface of the first insulating body 1. The guiding slots 114 are located at top left and top right corners of the first insulating body 1 and are located outside of the corresponding protrusions 112. Of course, in other embodiments, the guiding slots 114 may also be provided on the top surface or the side surface of the first insulating body 1. The two guiding slots 114 are corresponding to each other, and they are located on the left and right sides of the first connector 100, respectively.

In addition, the upper shell 31 is provided with a locking plate 311 covering the receiving space 113, and the locking plate 311 is provided with at least one locking hole 3111. The upper shell 31 includes a first top surface 34 covering the guiding slots 114 and a second top surface 35 covering the receiving space 113. The first top surface 34 and the second top surface 35 are substantially flush with each other. This arrangement can reduce height of the first connector 100. In addition, the receiving space 113 overlaps the first contact portions 2122 and the second contact portions 2222 in a vertical direction. As a result a length of the first connector 100 along a front-rear direction is reduced. The upper shell 31 also includes a T-shaped bent portion 3112 formed by bending downwardly from the locking plate 311. The T-shaped bent portion 3112 is locked in the corresponding notch 1121 in order to prevent the first shell 3 from detaching from the first insulating housing 1 in an X direction and a Y direction (a horizontal direction). The side shells 33 are respectively provided with protruding tabs 331 buckled in the retaining grooves 131 to prevent the first shell 3 from being separated from the first insulating body 1 in a Z direction (the vertical direction).

Figure 14:
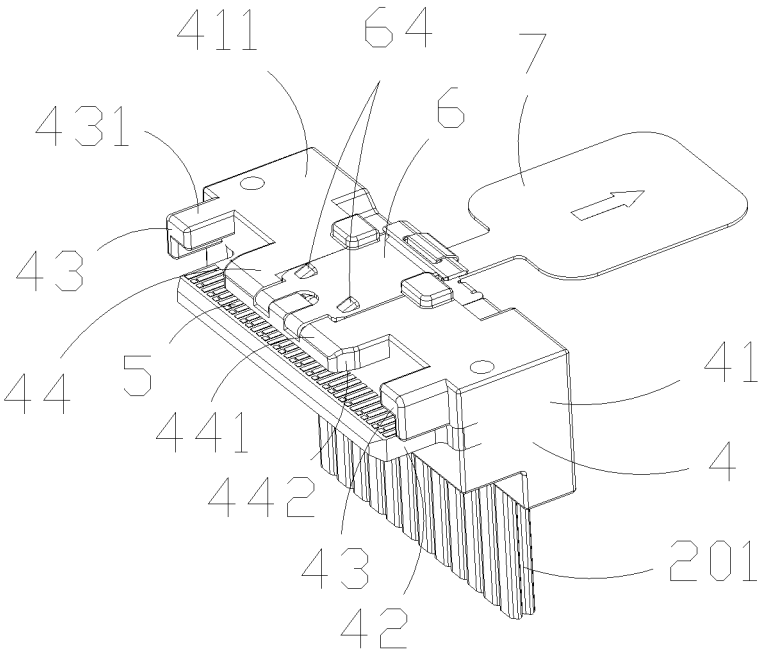
FIG. 14 is a perspective view of a second connector in FIG. 2.
Figure 15:
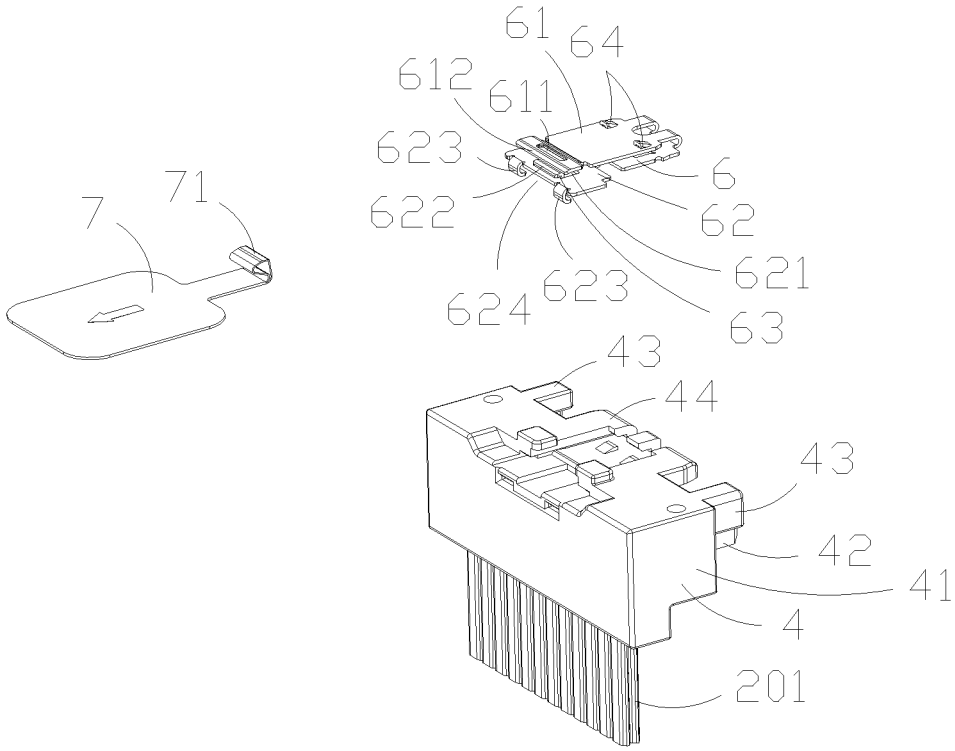
FIG. 15 is a partially exploded perspective view of FIG. 14.
Figure 16:
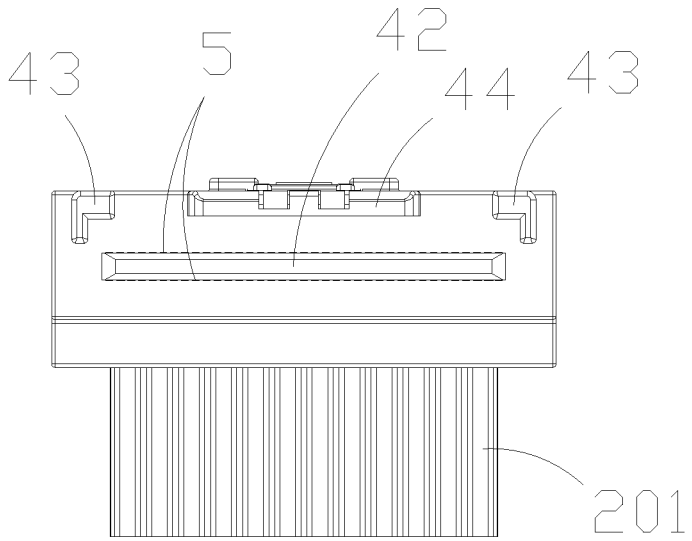
FIG. 16 is a front view of FIG. 14.

Referring to FIGS. 14 to 16, the second connector 200 includes a second insulating body 4, a second terminal module 5 disposed in the second insulating body 4, a locking piece 6 installed on the second insulating body 4 and a pulling tab 7 connected to the locking piece 6. The pulling tab 7 is a flexible pulling strap in the illustrated embodiment of the present disclosure.

In the illustrated embodiment of the present disclosure, the second insulating body 4 includes a main body 41, a tongue plate 42 protruding from the main body 41, two guiding protrusions 43 protruding from two sides of the main body 41, and an extending portion 44 protruding from the main body 41 and located above the tongue plate 42. In the illustrated embodiment of the present disclosure, the tongue plate 42 is formed by a circuit board. The guiding protrusions 43 and the extending portion 44 are both integrally extended from the main body 41. Each guiding protrusion 43 is L-shaped in order to match the L-shaped guiding slot 114. A top surface 431 of the guiding protrusion 43 is flush with a top surface 411 of the main body 41 or lower than the top surface 411 of the main body 41, so that the guiding protrusions 43 are capable of mating with the guiding slots 114. Of course, in other embodiments, the guiding protrusions 43 may also have other shapes, or may be separated parts from the main body 41 while being assembled together. For example, the guiding protrusion 43 is a metal piece which is disposed in the main body 41 through a slot, or insert-molded with the main body 41.

In the illustrated embodiment of the present disclosure, the second terminal module 5 is of a flat shape and is distributed on upper and lower surfaces of the tongue plate 42. Combination of the second terminal module 5 and the tongue plate 42 can be a circuit board with contact pieces or golden fingers (PINs). The second terminal module 5 is electrically connected to the cables 201. An end of the extending portion 44 is provided with an inclined guiding surface 441 for guiding the extending portion 44 to be inserted into the receiving space 113 and two guiding slopes 442 located on two sides of the extending portion 44. The L-shaped guiding protrusions 43 are used for being inserted into the L-shaped guiding slots 114.

The extending portion 44 protrudes forwardly of the main body 41 to save space and reduce the length of the second connector 200 along the front-rear direction. In addition, the extending portion 44 and the tongue plate 42 at least overlap in the vertical direction to save space and reduce the length of the second connector 200 along the front-rear direction. In addition, the top surface of the second insulating body 4 is substantially flat so as to reduce the height of the second connector 200 along the vertical direction.

The locking piece 6 is fixed on the extending portion 44. A top surface of the locking piece 6 is substantially flush with a top surface of the main body 41 so as to reduce the height of the second connector 200. In an embodiment of the present disclosure, the locking piece 6 is insert-molded with the extending portion 44. The locking piece 6 includes a locking portion 64 protruding upwardly. When the second connector 200 is mated with the first connector 100, the extending portion 44 is inserted into the receiving space 113. At this time, the locking portion 64 is locked in the locking hole 3111 so as to prevent the second connector 200 and the first connector 100 from loosening with respect to each other.

In the illustrated embodiment of the present disclosure, the locking piece 6 is made of sheet metal in order to increase the structural strength and reduce the overall height of the second connector 200. Please refer to FIG. 15, in the illustrated embodiment of the present disclosure, the locking piece 6 includes an upper plate 61 and a lower plate 62, wherein the upper plate 61 is provided with an upper through hole 611 and a first guide surface 612 located at the rear end of the upper through hole 611. The first guide surface 612 is an inclined surface which is inclined to the lower plate 62. The lower plate 62 is provided with a lower through hole 621, a second guide surface 622 located beside the lower through hole 621 and the two holding portions 623 located on two sides thereof. In the illustrated embodiment of the present disclosure, the lower plate 62 is provided with a protrusion 63 on which the second guide surface 622 is located. A guiding groove 624 for guiding the pulling tab 7 is formed between the two holding portions 623.

Figure 17:
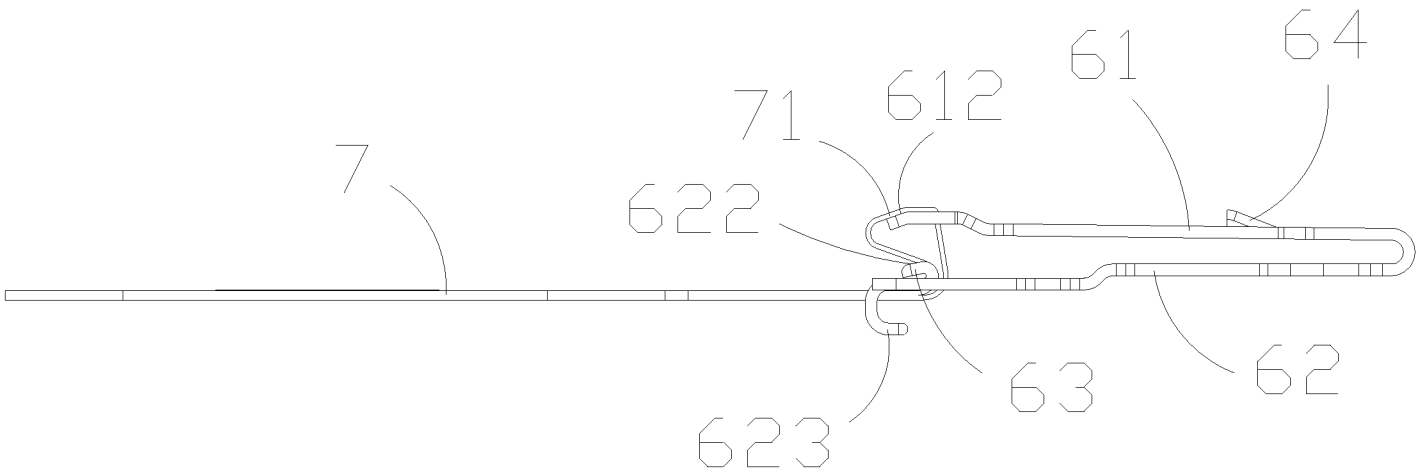
FIG. 17 is a schematic view of a state before a locking piece is matched with a pulling tab and the locking piece is unlocked.

The pulling tab 7 is provided with a hook 71 extending through the upper through hole 611 and the lower through hole 621. The upper through hole 611 and the lower through hole 621 at least partially overlap in the vertical direction so as to increase the pulling force of the pulling tab 7. Please refer to FIGS. 5 and 17, when the locking portion 64 is locked in the locking hole 3111 (that is, the locking portion 64 is in a state before unlocking), the upper plate 61 and the lower plate 62 are substantially parallel to each other. At this time, the locking portion 64 is at a high position so that it can be locked in the locking hole 3111.

Figure 18:
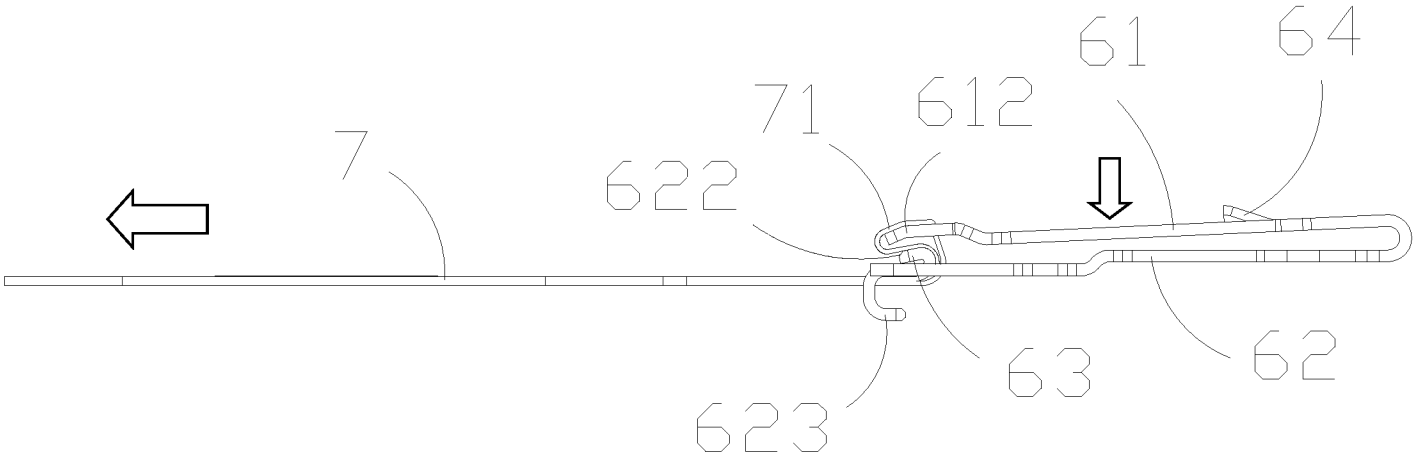
FIG. 18 is a schematic view of a state when the locking piece and the pulling tab in FIG. 17 are matched and the locking piece is unlocked.

Please refer to FIG. 18, when the pulling tab 7 is pulled back horizontally along an arrow direction, the hook 71 and the first guide surface 612 mate with each other to produce a downward split in the vertical direction so that the upper plate 61 is inclined downwardly along the arrow direction. At this time, the position of the locking portion 64 is lowered to a position where the locking portion 64 is unlock with the locking hole 3111. That is, by applying a horizontal pulling force onto the pulling tab 7, the second connector 200 can be pulled out of the first connector 100.

It should be noted that terms beginning with "first", "second" and "third" used in this disclosure are only for distinguishing names of elements and do not have any logical meaning, explicitly or implicitly.

The above embodiments are only used to illustrate the present disclosure and not to limit the technical solutions described in the present disclosure. The understanding of this specification should be based on those skilled in the art. Descriptions of directions, such as "front", "back", "left", "right", "top" and "bottom", although they have been described in detail in the above-mentioned embodiments of the present disclosure, those skilled in the art should understand that modifications or equivalent substitutions can still be made to the application, and all technical solutions and improvements that do not depart from the spirit and scope of the application should be covered by the claims of the application.

What is claimed is:

1. A first connector comprising:

a first insulating body comprising a first top wall, a mating surface and a slot formed on the mating surface, the slot being adapted for receiving at least part of a second connector along a mating direction;

a first terminal module comprising a plurality of contact portions extending into the slot; and a first shell shielding the first insulating body; wherein the first shell comprises an upper shell shielding the first top wall, and the upper shell comprises a locking plate for locking with the second connector; wherein the first connector comprises a receiving space provided between the first top wall and the locking plate for positioning the second connector with a second insulating body and a locking piece; wherein the locking plate, the second insulating body and the locking piece are substantially flush with each other on a top side so as to reduce a height of the first connector; and wherein a width of the receiving space is narrower than a width of the slot along a width direction perpendicular to the mating direction.

2. The first connector according to claim 1, wherein the first top wall comprises two protrusions adjacent to two sides of the first top wall, respectively, and the receiving space is located between the two protrusions;

wherein each of the two protrusions comprises a notch on a front end surface of the protrusion, each notch includes a first notch at an upper end and a second notch at a lower end, the first notch is in communication with the second notch, a width of the first notch is smaller than a width of the second notch along a width direction perpendicular to the mating direction;

wherein the upper shell comprises two bent portions bent downwardly from the locking plate, and the bent portions are locked in corresponding notches so as to prevent the first shell from being separated from the first insulating body in a vertical direction perpendicular to the mating direction and the width direction; and wherein each of the bent portions and each of the notches are of inverted T-shaped configurations.

3. The first connector according to claim 1, wherein the first terminal module comprises a first terminal unit, a second terminal unit, and a conductive plastic clamped between the first terminal unit and the second terminal unit.

4. The first connector according to claim 3, wherein the first terminal unit and the second terminal unit are symmetrically arranged on upper and lower sides of the conductive plastic.

5. The first connector according to claim 3, wherein the first terminal unit comprises a first insulator and a plurality of first terminals insert-molded with the first insulator;

wherein the second terminal unit comprises a second insulator and a plurality of second terminals insert-molded with the second insulator;

wherein the conductive plastic is provided with a plurality of protruding ribs on upper and lower surfaces of the conductive plastic, and an inner surface of the first insulator and an inner surface of the second insulator are respectively provided with a plurality of grooves to receive the protruding ribs.

6. The first connector according to claim 5, wherein the conductive plastic is provided with two first engaging arms, the first insulator is provided with a second engaging arm, the second insulator is provided with a third engaging arm, extending directions of the first engaging arms are opposite to extending directions of the second engaging arm and the third engaging arm;

wherein one of the first engaging arms is engaged with the second engaging arm, and the other of the first engaging arms is engaged with the third engaging arm, so that the conductive plastic is prevented from withdrawing backwardly after being inserted between the first insulator and the second insulator; and wherein the conductive plastic is isolated from the first terminals and the second terminals by a plastic layer, and the protruding ribs of the conductive plastic are not in direct contact with the first terminals and the second terminals.

7. The first connector according to claim 1, further comprising two corresponding guiding slots for guiding insertion of the second connector.

8. The first connector according to claim 7, wherein the guiding slots are formed by the first insulating body; or the guiding slots are formed by the first shell; or the guiding slots are jointly formed by the first insulating body and the first shell.

9. The first connector according to claim 7, wherein the guiding slots are located at top left and top right corners of the first insulating body, respectively; and wherein the guiding slots are located at a top surface or a side surface of the first insulating body.

10. The first connector according to claim 7, wherein the guiding slots are located at top left and top right corners of the first insulating body, respectively; and wherein the guiding slots are located at a top surface and a side surface of the first insulating body.

11. The first connector according to claim 7, wherein the upper shell comprises a first top surface covering the guiding slots and a second top surface covering the receiving space; and wherein the first top surface and the second top surface are substantially flush with each other.

12. A second connector comprising:

a second insulating body; and a second terminal module; wherein the second insulating body comprises a main body, a tongue plate protruding from the main body and an extending portion protruding from the main body; wherein the extending portion is located above the tongue plate, and the extending portion and the tongue plate at least partially overlap along a vertical direction;

wherein the second connector further comprises a locking piece and a pulling tab connected to the locking piece; the locking piece is installed on the second insulating body; a top surface of the locking piece is substantially flush with a top surface of the main body so as to reduce a height of the second connector; the locking piece includes an upper plate and a lower plate; when the locking piece is at a locking position, the upper plate and the lower plate are substantially parallel to each other; and when the pulling tab is pulled back to remove the locking piece from the locking position, the upper plate is driven downwardly by the pulling tab so as to be inclined with respect to the lower plate.

13. The second connector according to claim 12, wherein the upper plate includes an upper through hole and a locking portion protruding upwardly, the lower plate defines a lower through hole, the upper through hole and the lower through hole at least partially overlap in the vertical direction, the pulling tab is provided with a hook extending through the upper through hole and the lower through hole; and wherein the upper plate comprises a first guide surface located at a rear end of the upper through hole, the first guide surface is an inclined surface which is inclined to the lower plate; wherein the lower plate comprises a second guide surface located beside the lower through hole and the two holding portions located on two sides of the second guide surface, and a guiding groove for guiding the pulling tab is formed between the two holding portions.

14. The second connector according to claim 12, wherein an end of the extending portion is provided with an inclined guiding surface and two guiding slopes which are located on two sides of the extending portion.

15. The second connector according to claim 12, wherein the second insulating body comprises two guiding protrusions protruding from two sides of the main body, respectively; the guiding protrusions are adapted for being inserted into a first connector; and a top surface of each guiding protrusion is flush with or lower than a top surface of the main body.

16. The second connector according to claim 15, wherein each guiding protrusion is L-shaped; and wherein the two guiding protrusions are integrally extended from the main body, or the two guiding protrusions and the main body are two different components which are assembled together.

17. A connector assembly comprising:

a first connector and a second connector for mating with the first connector along a mating direction, the first connector comprising:

a first insulating body comprising a first top wall, a mating surface and a slot formed on the mating surface;

a first terminal module; and a first shell shielding the first insulating body; wherein the first shell comprises an upper shell shielding the first top wall, and the upper shell comprises a locking plate for locking with the second connector; wherein the first connector comprises a receiving space provided between the first top wall and the locking plate for positioning the second connector; and wherein a width of the receiving space is narrower than a width of the slot along a width direction perpendicular to the mating direction; and the second connector comprising:

a second insulating body; and a second terminal module; wherein the second insulating body comprises a main body, a tongue plate protruding from the main body and an extending portion protruding from the main body; wherein the extending portion is located above the tongue plate, and the extending portion and the tongue plate at least partially overlap along a vertical direction perpendicular to the mating direction; wherein when the first connector and the second connector are mated, the tongue plate is received in the slot and the extending portion is received in the receiving space;

wherein the second connector further comprises a locking piece installed on the second insulating body and a pulling tab connected to the locking piece, a top surface of the locking piece is substantially flush with a top surface of the main body so as to reduce a height of the second connector;

wherein the locking piece includes an upper plate and a lower plate, the upper plate includes an upper through hole and a locking portion protruding upwardly, the lower plate defines a lower through hole, the upper through hole and the lower through hole at least partially overlap in the vertical direction, the pulling tab is provided with a hook extending through the upper through hole and the lower through hole; and wherein when the locking piece is at a locking position, the upper plate and the lower plate are substantially parallel to each other; and when the pulling tab is pulled back to remove the locking piece from the locking position, the upper plate is driven downwardly so as to be inclined with respect to the lower plate.

18. The connector assembly according to claim 17, wherein the second insulating body comprises two guiding protrusions protruding from two sides of the main body, respectively; and a top surface of each guiding protrusion is flush with or lower than a top surface of the main body; and wherein The first connector comprises two corresponding guiding slots to receive the two guiding protrusions.

19. The connector assembly according to claim 18, wherein the guiding slots are formed by the first insulating body; or the guiding slots are formed by the first shell; or the guiding slots are jointly formed by the first insulating body and the first shell.

20. The connector assembly according to claim 17, wherein the first insulating body comprises a first bottom wall and two first side walls connecting the first top wall and the first bottom wall, the slot is surrounded by the first top wall, the first bottom wall and the two first side walls, and the receiving space is located above the slot and separated from the slot by the first top wall.

* * * * *